US011499417B2

(12) United States Patent
Fripp et al.

(10) Patent No.: US 11,499,417 B2
(45) Date of Patent: Nov. 15, 2022

(54) METHODS TO MONITOR A METALLIC SEALANT DEPLOYED IN A WELLBORE, METHODS TO MONITOR FLUID DISPLACEMENT, AND DOWNHOLE METALLIC SEALANT MEASUREMENT SYSTEMS

(71) Applicant: Halliburton Energy Services, Inc., Houston, TX (US)

(72) Inventors: Michael Linley Fripp, Carrollton, TX (US); Stephen Michael Greci, Little Elm, TX (US); John Todd Broome, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/484,000

(22) PCT Filed: Jul. 31, 2019

(86) PCT No.: PCT/US2019/044542
§ 371 (c)(1),
(2) Date: Aug. 6, 2019

(87) PCT Pub. No.: WO2021/021203
PCT Pub. Date: Feb. 4, 2021

(65) Prior Publication Data

US 2021/0032980 A1 Feb. 4, 2021

(51) Int. Cl.
*E21B 47/07* (2012.01)
*E21B 33/12* (2006.01)
(Continued)

(52) U.S. Cl.
CPC ..... *E21B 47/07* (2020.05); *E21B 23/0417* (2020.05); *E21B 33/1212* (2013.01); *E21B 47/06* (2013.01); *E21B 47/117* (2020.05)

(58) Field of Classification Search
CPC .... E21B 43/267; E21B 47/07; E21B 33/1212; E21B 47/117; E21B 23/0417; E21B 47/06; E21B 33/1208
See application file for complete search history.

(56) References Cited

U.S. PATENT DOCUMENTS 1,982,569 A 11/1934 Byrd
3,046,601 A 7/1962 Hubbert et al.
(Continued)

FOREIGN PATENT DOCUMENTS

CA 2751473 A1 8/2010
CA 2751473 C 9/2014
(Continued)

OTHER PUBLICATIONS

International Search Report and Written Opinion dated Apr. 28, 2020; International PCT Application No. PCT/US2019/044542.
(Continued)

*Primary Examiner* — Abby J Flynn
*Assistant Examiner* — Yanick A Akaragwe
(74) *Attorney, Agent, or Firm* — McGuireWoods LLP

(57) ABSTRACT

The disclosed embodiments include methods to monitor expansion of a metallic sealant deployed in a wellbore, methods to monitor downhole fluid displacement, and downhole metallic sealant measurement systems. The method to monitor expansion of a downhole metallic sealant includes deploying a metallic sealant deployed along a section of a wellbore. The method also includes exposing the metallic sealant to a reacting fluid to initiate a galvanic reaction. The method further includes measuring a change in temperature caused by the galvanic reaction. The method further includes determining an amount of expansion of the metallic sealant based on the change in the temperature.

20 Claims, 5 Drawing Sheets

(51) Int. Cl.

| | |
|---|---|
| ***E21B 47/117*** | (2012.01) |
| ***E21B 47/06*** | (2012.01) |
| ***E21B 23/04*** | (2006.01) |

(56) References Cited

U.S. PATENT DOCUMENTS 3,385,367 A 5/1968 Kollsman
4,445,694 A 5/1984 Flaherty
4,612,985 A 9/1986 Rubbo et al.
4,846,278 A 7/1989 Robbins
5,139,235 A 8/1992 Kilmer
5,163,321 A * 11/1992 Perales ..... G01K 13/02 73/152.52
5,803,177 A 9/1998 Hriscu et al.
6,098,717 A 8/2000 Bailey et al.
6,321,861 B1 11/2001 Leichter
6,367,845 B1 4/2002 Otten et al.
6,640,893 B1 11/2003 Rummel et al.
6,695,061 B2 2/2004 Fripp et al.
7,007,910 B1 3/2006 Krinner et al.
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
7,984,762 B2 7/2011 Renshaw et al.
8,083,000 B2 12/2011 Nutley et al.
8,235,075 B2 8/2012 Saltel
8,240,377 B2 8/2012 Kulakofsky et al.
8,434,571 B2 5/2013 Kannan et al.
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 * 8/2016 Mazyar ..... C09K 8/50
9,518,453 B2 12/2016 Dilber et al.
9,605,508 B2 3/2017 Xu et al.
9,624,752 B2 4/2017 Resink
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 10/2019 Vasques
10,704,362 B2 7/2020 Themig et al.
10,851,615 B2 12/2020 Watson et al.
10,961,804 B1 3/2021 Fripp et al.
2002/0125008 A1 9/2002 Wetzel et al.
2003/0150614 A1 8/2003 Brown et al.
2004/0118572 A1 6/2004 Whanger et al.
2004/0149418 A1 8/2004 Bosma et al.
2004/0244994 A1 12/2004 Jackson et al.
2005/0039927 A1 2/2005 Wetzel et al.
2005/0092485 A1 5/2005 Brezinski et al.
2005/0171248 A1 8/2005 Li et al.
2005/0199401 A1 9/2005 Patel et al.
2005/0257961 A1 * 11/2005 Snell ..... E21B 47/017 175/40
2006/0175065 A1 8/2006 Ross
2007/0089911 A1 4/2007 Moyes
2007/0095532 A1 5/2007 Head et al.
2007/0125532 A1 6/2007 Murray et al.
2007/0200299 A1 8/2007 Kunz
2007/0257405 A1 11/2007 Freyer
2008/0066931 A1 3/2008 Xu
2008/0142214 A1 6/2008 Keller
2008/0149351 A1 6/2008 Marya et al.
2008/0185150 A1 8/2008 Brown
2008/0185158 A1 8/2008 Chalker et al.
2008/0220991 A1 9/2008 Slay et al.
2009/0020286 A1 1/2009 Johnson
2009/0120640 A1 5/2009 Kulakofsky et al.
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0163252 A1 7/2010 Regnault De La Mothe et al.
2010/0212891 A1 * 8/2010 Stewart ..... E21B 23/00 166/250.12
2010/0270031 A1 10/2010 Patel
2010/0307770 A1 12/2010 Sponchia et al.
2011/0073310 A1 3/2011 Clemens
2011/0098202 A1 4/2011 James et al.
2011/0226374 A1 9/2011 Kalman
2011/0252879 A1 * 10/2011 Madhavan ..... E21B 49/10 73/152.33
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0132427 A1 5/2012 Renshaw et al.
2012/0175134 A1 7/2012 Robisson et al.
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2013/0056196 A1 3/2013 Hench
2013/0056227 A1 3/2013 Sponchia
2013/0056228 A1 3/2013 Gruetzmann et al.
2013/0146312 A1 6/2013 Gerrard et al.
2013/0248179 A1 9/2013 Yeh et al.
2014/0051612 A1 2/2014 Mazyar et al.
2014/0054047 A1 2/2014 Zhou
2014/0060815 A1 3/2014 Wang et al.
2014/0238692 A1 8/2014 Watson
2014/0251641 A1 9/2014 Marya et al.
2014/0262351 A1 9/2014 Derby
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0267501 A1 9/2015 Al-Gouhi
2015/0275644 A1 10/2015 Chen et al.
2015/0308214 A1 10/2015 Bilansky et al.
2015/0344772 A1 12/2015 Droger et al.
2015/0369027 A1 12/2015 Jones et al.
2016/0032696 A1 2/2016 Caccialupi et al.
2016/0137912 A1 5/2016 Sherman et al.
2016/0138359 A1 5/2016 Zhao et al.
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko
2016/0230495 A1 8/2016 Mazyar et al.
2016/0319633 A1 11/2016 Cooper et al.
2016/0376869 A1 12/2016 Rochen et al.
2016/0376870 A1 12/2016 Roselier et al.
2017/0122062 A1 5/2017 Freyer
2017/0191343 A1 7/2017 Solhaug
2017/0335673 A1 11/2017 Burke et al.
2018/0078998 A1 3/2018 Sherman
2018/0085154 A1 3/2018 Kuiper et al.
2018/0087346 A1 3/2018 Rochen
2018/0087350 A1 3/2018 Sherman
2018/0266215 A1 9/2018 Fagley, IV et al.
2018/0355691 A1 12/2018 Andersen

(56) References Cited

U.S. PATENT DOCUMENTS

| | | | |
|---|---|---|---|
| 2018/0355693 | A1 | 12/2018 | Al-AbdulJabbar et al. |
| 2019/0017285 | A1 | 1/2019 | Kain |
| 2019/0055808 | A1 | 2/2019 | Krueger |
| 2019/0055839 | A1 | 2/2019 | Skillingstad et al. |
| 2019/0128074 | A1 | 5/2019 | Stokes et al. |
| 2019/0153852 | A1 | 5/2019 | Lallemand et al. |
| 2019/0203101 | A1 | 7/2019 | Dusterhoft et al. |
| 2019/0249509 | A1 | 8/2019 | Jakkula et al. |
| 2019/0360297 | A1 | 11/2019 | Heiman et al. |
| 2020/0240235 | A1 | 7/2020 | Fripp et al. |
| 2020/0325749 | A1 | 10/2020 | Fripp et al. |
| 2020/0370391 | A1 | 11/2020 | Fripp et al. |
| 2021/0017441 | A1 | 1/2021 | Fripp et al. |
| 2021/0079756 | A1 | 3/2021 | Ornelaz et al. |
| 2021/0140255 | A1 | 5/2021 | Greci et al. |
| 2021/0189817 | A1 | 6/2021 | Fripp et al. |
| 2021/0332659 | A1 | 10/2021 | Fripp et al. |
| 2021/0353037 | A1 | 11/2021 | Cote |
| 2022/0074221 | A1 | 3/2022 | Laimbeer et al. |

FOREIGN PATENT DOCUMENTS

| | | | | |
|---|---|---|---|---|
| CA | 3085547 | A1 | 8/2019 | |
| CN | 1708631 | A | 12/2005 | |
| CN | 102027189 | A | 4/2011 | |
| CN | 104583530 | A | 4/2015 | |
| CN | 105422146 | A | 3/2016 | |
| CN | 106522923 | | 3/2017 | |
| CN | 107148444 | A | 9/2017 | |
| CN | 107250321 | A | 10/2017 | |
| CN | 107532466 | A | 1/2018 | |
| EP | 2399000 | A2 | 12/2011 | |
| EP | 2217790 | B1 | 10/2016 | |
| EP | 2753791 | B1 | 6/2017 | |
| FR | 3073549 | A1 | 5/2019 | |
| GB | 2381278 | A | 4/2003 | |
| GB | 2416796 | A | 2/2006 | |
| GB | 2469723 | A | 10/2010 | |
| GB | 2514195 | B | 6/2019 | |
| GB | 2583232 | A | 10/2020 | |
| GB | 2557397 | B | 8/2021 | |
| MX | 2011008597 | A | 9/2011 | |
| RU | 2424419 | C1 | 7/2011 | |
| RU | 2588501 | C2 | 6/2016 | |
| RU | 182236 | U1 | 8/2018 | |
| WO | 0026501 | A1 | 5/2000 | |
| WO | 2008079486 | A1 | 7/2008 | |
| WO | 2010096417 | A2 | 8/2010 | |
| WO | 2012090056 | A2 | 7/2012 | |
| WO | 2013033208 | A1 | 3/2013 | |
| WO | 2014098885 | A1 | 6/2014 | |
| WO | 2014110382 | A1 | 7/2014 | |
| WO | 2014210283 | A1 | 12/2014 | |
| WO | 2016171666 | A1 | 10/2016 | |
| WO | 2018005740 | A1 | 1/2018 | |
| WO | 2018057361 | A1 | 3/2018 | |
| WO | WO-2018085102 | A1 * | 5/2018 | ..... E21B 17/1028 |
| WO | 2018147833 | A1 | 8/2018 | |
| WO | 2019094044 | A1 | 5/2019 | |
| WO | 2019147285 | A1 | 8/2019 | |
| WO | 2019164492 | A1 | 8/2019 | |
| WO | 2019164499 | A1 | 8/2019 | |
| WO | 2020005252 | A1 | 1/2020 | |
| WO | 2020018110 | A1 | 1/2020 | |
| WO | 2021021203 | | 2/2021 | |
| WO | 2021076141 | A1 | 4/2021 | |

OTHER PUBLICATIONS

Netherlands Search Report dated Mar. 2, 2021, Netherlands Application No. 2025954.
Examination Report in GCC Application No. GC 2020-40201, dated Aug. 31, 2021.
International Search Report and Written Opinion dated Aug. 2, 2018, International PCT Application No. PCT/US2017/061307.
Search Report in FR Application No. 1859379, dated Oct. 15, 2019.
International Search Report and Written Opinion dated Nov. 19, 2018; International PCT Application No. PCT/US2018/019337.
Denmark Examination Report and Search Report date dated Mar. 16, 2021, Denmark Application No. PA202070389.
International Search Report and Written Opinion dated Jul. 8, 2020, issued in related International Application No. PCT/US2019/056814.
International Search Report and Written Opinion for corresponding PCT International Application No. PCT/US2019/068497; dated Sep. 17, 2020.
International Search Report and Written Opinion for corresponding International Patent Application No. PCT/US2019/062225, dated Aug. 11, 2020.
International Search Report and Written Opinion issued in related PCT/US2019/068493 dated Sep. 15, 2020.
NEMISIS Annulus Swellable Packer, Weatherford, Swellable Products, 2009-2011.
International Search Report and Written Opinion dated Nov. 22, 2019; International PCT Application No. PCT/US2019/019210.
International Search Report and Written Opinion dated May 20, 2020, issued in related PCT/US2019/047529.
Tao, Solid expandable tubular patching technique for high-temperature and high-pressure casing damaged wells, Research Paper, Jun. 2015, pp. 408-413, Petroleum Exploration and Development, vol. 42, Issue 3.
Dutch Search Report issued in NL 2026726, dated Aug. 13, 2021.
International Search Report and Written Opinion in PCT/US2020/066193, dated Sep. 8, 2021.
Search Report and Written Opinion issued in NL2026329, dated Aug. 13, 2021.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report and Written Opinion in PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report and Written Opinion in PCT/US2019/017538, dated Nov. 11, 2019.
Chinese Search Report date dated Dec. 17, 2021; CN Application No. 2018800875885.
Examination Report in GB Appln No. 2010931.0 dated, Jan. 18, 2022.
International Search Report and Written Opinion in PCT/US2020/065539, dated Aug. 30, 2021.
International Search Report and Written Opinion in PCT/US2019/058904, dated Jul. 23, 2020.
French Search Report issued in FR Appln No. FR2006166, dated May 30, 2022.
International Search Report and Written Opinion in PCT/US2021/048628 dated May 19, 2022.
International Search Report and Written Opinion in PCT/US2021/027245 dated Jan. 10, 2022.
International Search Report and Written Opinion in PCT/US2021/032983, dated Feb. 10, 2022.
Netherlands Search Report in Application No. 2026573 dated Aug. 20, 2021.
Russian Office Action in RU Application No. 2021121198, dated Nov. 25, 2021.
GC Examination Report in GO Application No. 2019-38908, dated Nov. 4, 2020.
GC Examination Report in GO Application No. 2020-40475, dated Nov. 25, 2021.
MY Search Report in MY Application No. PI2020003430, dated May 26, 2022.

(56) References Cited

OTHER PUBLICATIONS

GB Examination Report in Application No. 2010931.0 dated Apr. 5, 2022.
DK Examination Report in Application No. PA 202070389, dated Oct. 20, 2021.

* cited by examiner

METHODS TO MONITOR A METALLIC SEALANT DEPLOYED IN A WELLBORE, METHODS TO MONITOR FLUID DISPLACEMENT, AND DOWNHOLE METALLIC SEALANT MEASUREMENT SYSTEMS

BACKGROUND

The present disclosure relates generally to methods to monitor a metallic sealant deployed in a wellbore, methods to monitor fluid displacement of fluids flowing in a wellbore, and downhole metallic sealant measurement systems.

Sealants, such as expandable packers, are sometimes deployed in a wellbore to isolate sections of the wellbore or to isolate sections of pipes deployed in the wellbore. Some sealants have outer diameters that are less than the outer diameter of a wellbore to allow initial deployment of the respective sealants. The respective sealants have material properties that allow the sealants to expand after the sealants are deployed at desirable locations in the wellbore. Some sealants are deployed hundreds of feet below the surface. As such, it is difficult to monitor deployment and expansion of sealants that are deployed downhole.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1A:
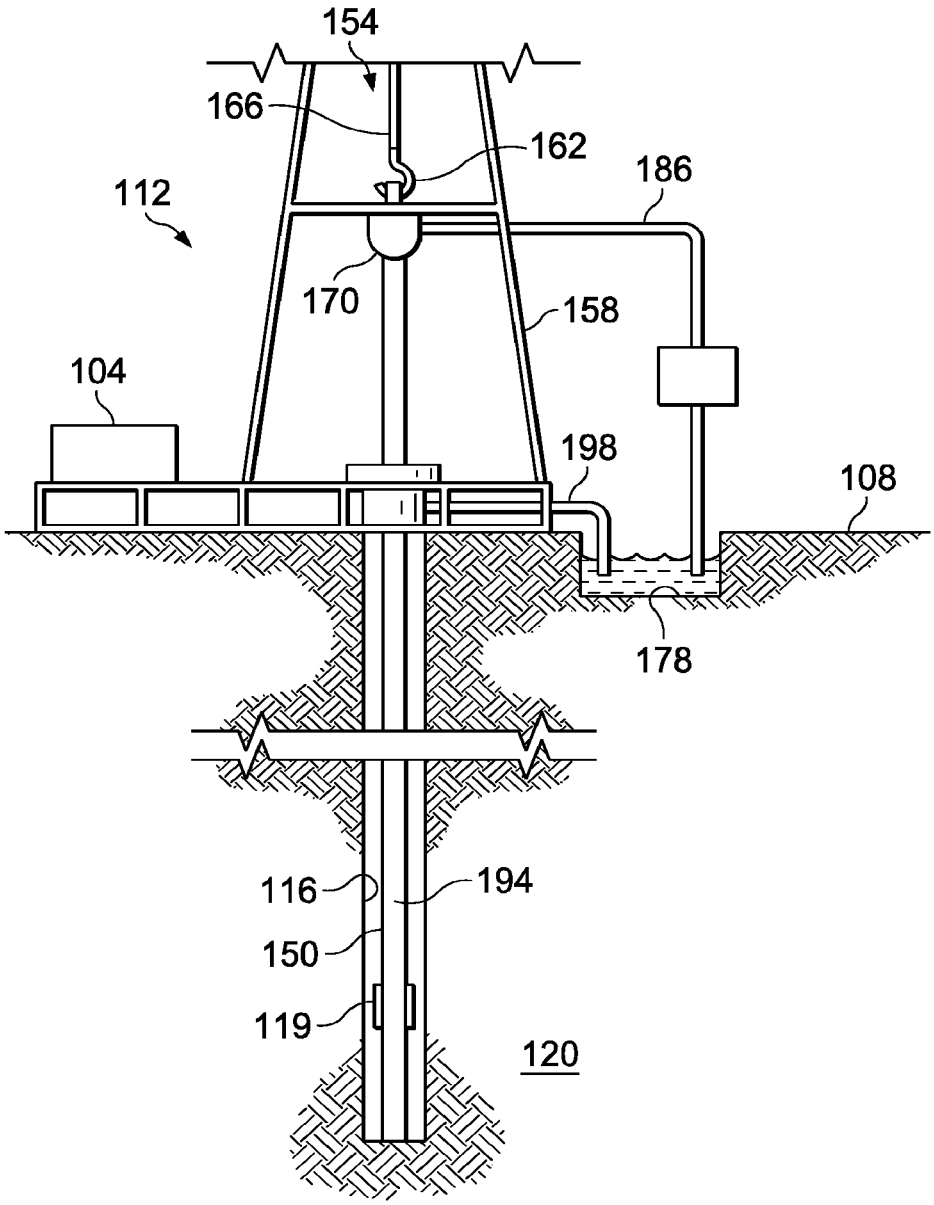
FIG. 1A illustrates a schematic view of an on-shore well having a metallic sealant measurement system deployed in the well.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to methods to monitor expansion of a metallic sealant deployed in a wellbore, methods to monitor fluid displacement of fluids flowing in a wellbore, and downhole metallic sealant measurement systems. As referred to herein, a sealant is any apparatus, device, or component that is deployable in a downhole environment and is operable to form a partial or complete seal of a section of a wellbore, between a wellbore and a string (e.g., between the outer diameter of a drill pipe and the wellbore), or another equipment deployed in the wellbore, or between equipment deployed in the wellbore (e.g., between the outer diameter of an inner string and the inner diameter of an outer string, between a tool deployed in a string and the inner diameter of the string, etc.). Examples of sealants include, but are not limited to, packers, bridge plugs, inflow control device plugs, autonomous inflow control device plugs, frac plugs, and frac balls. As referred to herein, a metallic sealant or a metal sealant is any sealant formed or partially formed from a metal or a metallic alloy. In some embodiments, the metallic sealant is constructed by forming the metal alloy via machining, casting, or a combination of both, extruded to size, or extruded then machined to size. Examples of metallic sealants include, but are not limited to, sealants partially or completely constructed from magnesium, aluminum, calcium, zinc, as well as other types of earth metals and transition metals. In some embodiments, the metallic sealant is a metal alloy of a base metal with other elements in order to either adjust the strength of the metal alloy, to adjust the reaction time of the metal alloy, or to adjust the strength of the resulting metal hydroxide byproduct. For example, metal alloy can be alloyed with elements that enhance the strength of the metal such as, but not limited to, aluminum, zinc, manganese, zirconium, yttrium, neodymium, gadolinium, silver, calcium, tin, and rhenium. In some embodiments, the alloy can be alloyed with a dopant that promotes corrosion, such as nickel, iron, copper, cobalt, iridium, gold, carbon, gallium, indium, mercury, bismuth, tin, and palladium. In some embodiments, the metallic sealant is constructed in a solid solution process where the elements are combined with molten metal or metal alloy. Alternatively, the metallic sealant is constructed with a powder metallurgy process. In some embodiments, the metallic sealant is cast, forged, extruded, or a combination thereof.

The metallic sealant is deployed at a desired location in the wellbore. In some embodiments, a reacting fluid flows into the wellbore to initiate a galvanic reaction. As referred to herein, a reacting fluid is any fluid having material properties that cause the metallic sealant to undergo a galvanic reaction after the respective fluid is exposed to the metallic sealant. Examples of reacting fluids include, but are not limited to, water, fluids containing salts, as well as other fluids that cause metallic sealant to undergo a galvanic reaction after the respective fluid is exposed to the metallic sealant. The galvanic reaction causes the metallic sealant to expand, filling the annulus, thereby creating a seal. In some embodiments, the metallic sealant is deployed in a wellbore that contains the reacting fluid. Heat is released as a byproduct of the galvanic reaction, and a temperature sensor deployed nearby measures a change in the temperature due to heat released from the galvanic reaction. In some embodiments, the temperature change is measured over a period of time (e.g., one millisecond, one second, one minute, or another period of time). In some embodiments, the temperature change is the temperature differential at two points (e.g., two points on the metallic sealant). In some embodiments, the temperature sensor is a fiber optic cable deployed along the wellbore. In some embodiments, the temperature sensor is a component of a logging tool or another equipment deployed in the wellbore. In some embodiments, the temperature sensor is a wired or wireless device deployed in the wellbore. The change in the temperature due to the galvanic reaction is utilized to determine the amount of expansion of the metallic sealant, and to determine whether a seal has been formed. In some embodiments, a dopant is added to the metallic sealant to increase or to decrease the rate of the galvanic reaction and to control the galvanic reaction to form a seal within a threshold period of time or within a predetermined period of time. Additional descriptions of metallic sealants, galvanic reactions, and the amount of heat released as a result of galvanic reactions are provided in the paragraphs below.

In some embodiments, where the integrity of a seal formed by a metallic seal is jeopardized, exposing the metallic seal to a reacting fluid allows the metallic seal to self-heal and to form a new seal. More particularly, after a previously-formed seal is broken, portions of the metallic seal that were not exposed to the reacting fluid to form the initial seal may be exposed to the reacting fluid (e.g., the initially unexposed portion of the metallic seal now forms a surface portion of the metallic seal). Further, exposure of the initially unexposed portion of the metallic seal causes the initially unexposed portion to expand, thereby forming a new seal. A change in temperature as a result of heat released from the galvanic reaction is measured and is used to determine the amount of the expansion of the metallic sealant, and to determine whether a new seal has been formed. In some embodiments, a pressure sensor (e.g., a component of the metallic sealant measurement system) detects a differential pressure on the metallic sealant, or across one or more points proximate to the metallic sealant. In one or more of such embodiments, and in response to determining a pressure differential greater than a threshold value, the metallic sealant measurement system determines that the initial seal has been broken. In one or more of such embodiments, additional reacting fluid is provided to initiate another galvanic reaction to allow the metallic sealant to self-heal and to form a new seal.

The foregoing may also be utilized to monitor fluid displacement within the wellbore. For example, where non-reacting fluid is in the wellbore, monitoring a temperature change due to a galvanic reaction caused by exposing the metallic sealant to a reacting fluid is also used to determine whether the non-reacting fluid has been displaced (e.g., into a return annulus that flows to the surface). As referred to herein, a non-reacting fluid is a fluid that does not cause a galvanic reaction with the metallic sealant when the metallic sealant is exposed to the non-reacting fluid. Continuing with the foregoing example, after the metallic sealant is exposed to the reacting fluid, a temperature change due to heat released as a byproduct of the galvanic reaction is measured to determine how much the metallic sealant expanded as a result of the galvanic reaction. In some embodiments, the expansion is a chemical reaction that changes the chemical composition of the metal as the metallic sealant chemically reacts to become a metal hydroxide. In one or more embodiments, the metal creates a pressure barrier between two sections of the wellbore. The volume of expansion is then utilized to determine the amount of non-reactive fluid displaced as a result of the expansion of the metallic sealant. Similarly, where the integrity of a seal formed by a metallic seal is jeopardized, exposing the metallic seal to the reacting fluid allows the metallic seal to self-heal, and to form a new seal. More particularly, after a previously-formed seal is broken, portions of the metallic seal that were not exposed to the reacting fluid to form the initial seal may be exposed to the reacting fluid, and exposure of the initially unexposed portion of the metallic seal causes the initially unexposed portion to expand, thereby forming a new seal. A change in temperature as a result of heat released from the galvanic reaction is measured and is used to determine the amount of expanded metallic sealant, and to determine the amount of the non-reactive fluid displaced as a result of the expansion of the metallic sealant. In some embodiments, where the amount of displaced fluid is measured (e.g., by a downhole sensor), the amount of expanded metallic sealant is determined based on the amount of the displaced fluid. In some embodiments, a sealant capacity of the metallic sealant is determined based on the amount of expansion of the metallic sealant. As referred to herein, a sealant capacity is a measure of differential pressure holding capability of a material, such as the metallic sealant. Additional details of the foregoing methods to monitor a metallic sealant deployed in a wellbore, methods to monitor fluid displacement of fluids flowing in a wellbore, and downhole metallic sealant measurement systems are provided in the paragraphs below and are illustrated in at least FIGS. 1-5.

Figure 1B:
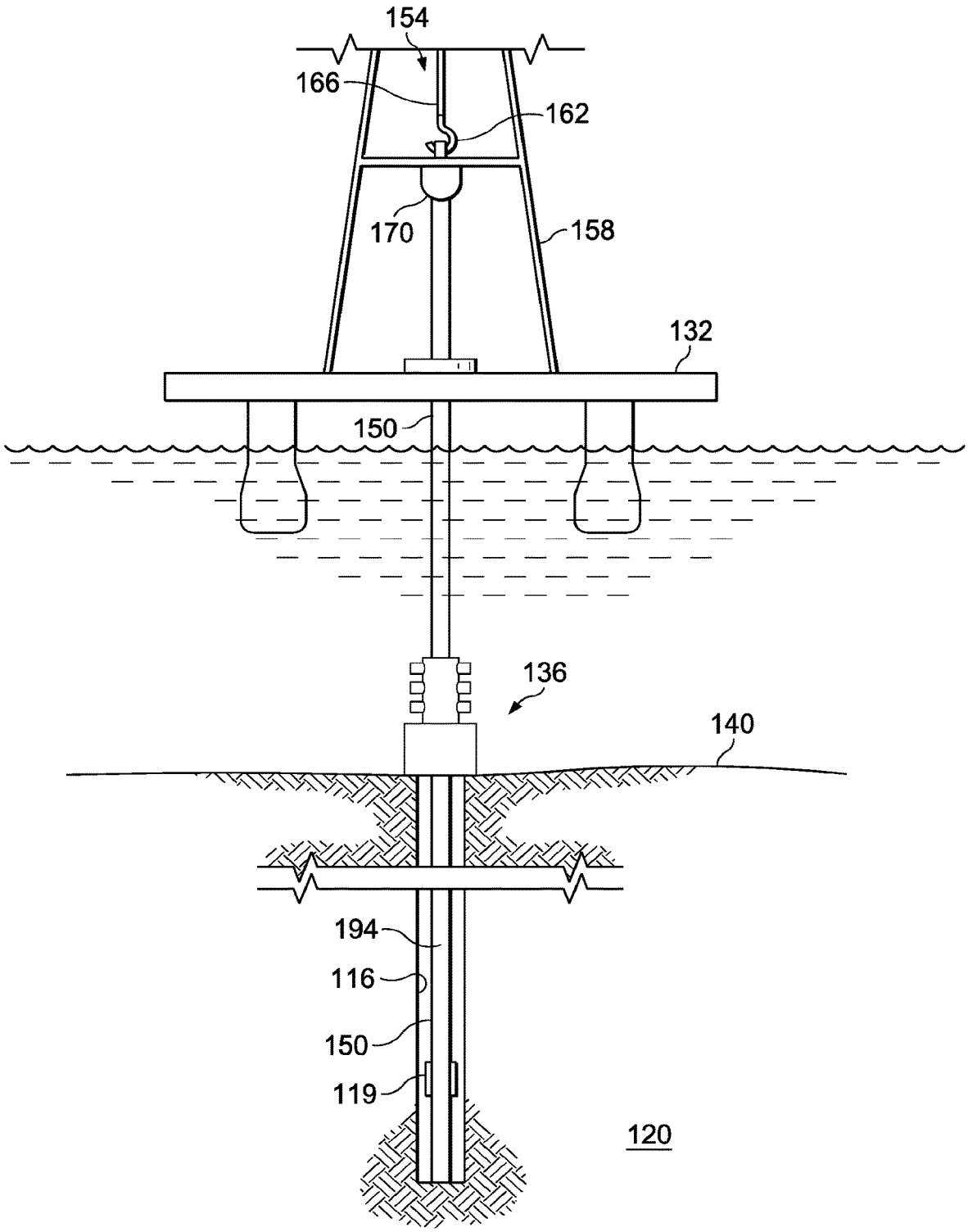
FIG. 1B illustrates a schematic view of an off-shore platform having a metallic sealant measurement system deployed in the well.

Now turning to the figures, FIG. 1A illustrates a schematic view of an on-shore well 112 having a metallic sealant measurement system 119 deployed in the well 112. The well 112 includes a wellbore 116 that extends from surface 108 of the well 112 to a subterranean substrate or formation 120. The well 112 and rig 104 are illustrated onshore in FIG. 1A. Alternatively, FIG. 1B illustrates a schematic view of an off-shore platform 132 having a metallic sealant measurement system 119 according to an illustrative embodiment. The metallic sealant measurement system 119 in FIG. 1B may be deployed in a sub-sea well 136 accessed by the offshore platform 132. The offshore platform 132 may be a floating platform or may instead be anchored to a seabed 140.

In the embodiments illustrated in FIGS. 1A and 1B, the wellbore 116 has been formed by a drilling process in which dirt, rock and other subterranean material is removed to create the wellbore 116. During or after the drilling process, a portion of the wellbore 116 may be cased with a casing (not illustrated). In other embodiments, the wellbore 116 may be maintained in an open-hole configuration without casing. The embodiments described herein are applicable to either cased or open-hole configurations of the wellbore 116, or a combination of cased and open-hole configurations in a particular wellbore.

After drilling of the wellbore 116 is complete and the associated drill bit and drill string are "tripped" from the wellbore 116, a work string 150, which may eventually function as a production string, is lowered into the wellbore 116. In some embodiments, the work string 150 includes an annulus 194 disposed longitudinally in the work string 150 that provides fluid communication between the surface 108 of the well 112 of FIG. 1A and a downhole location in the formation 120.

The lowering of the work string 150 may be accomplished by a lift assembly 154 associated with a derrick 158 positioned on or adjacent to the rig 104 as shown in FIG. 1A or offshore platform 132 as shown in FIG. 1B. The lift assembly 154 may include a hook 162, a cable 166, a traveling block (not shown), and a hoist (not shown) that cooperatively work together to lift or lower a swivel 170 that is coupled to an upper end of the work string 150. The work string 150 may be raised or lowered as needed to add additional sections of tubing to the work string 150 to position the metallic sealant measurement system 119 at the downhole location in the wellbore 116.

Figure 2A:
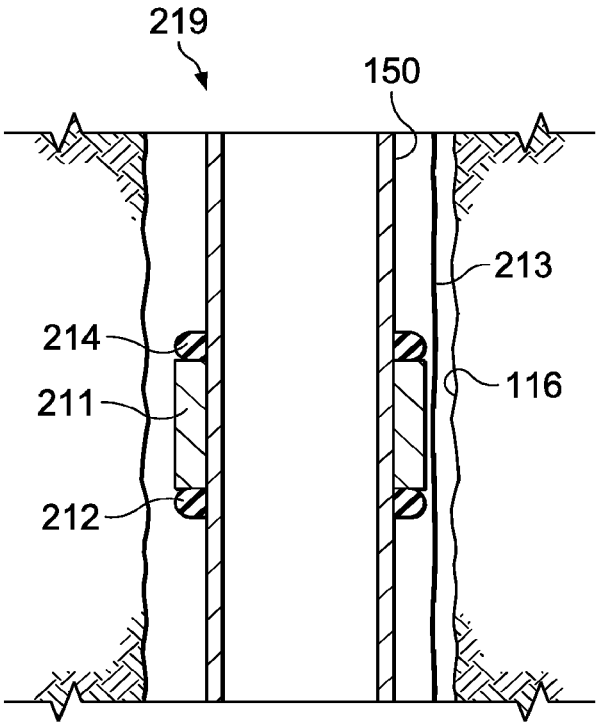
FIG. 2A illustrates a perspective view of a metallic sealant measurement system deployable in the environments of FIGS. 1A and 1B.
Figure 2B:
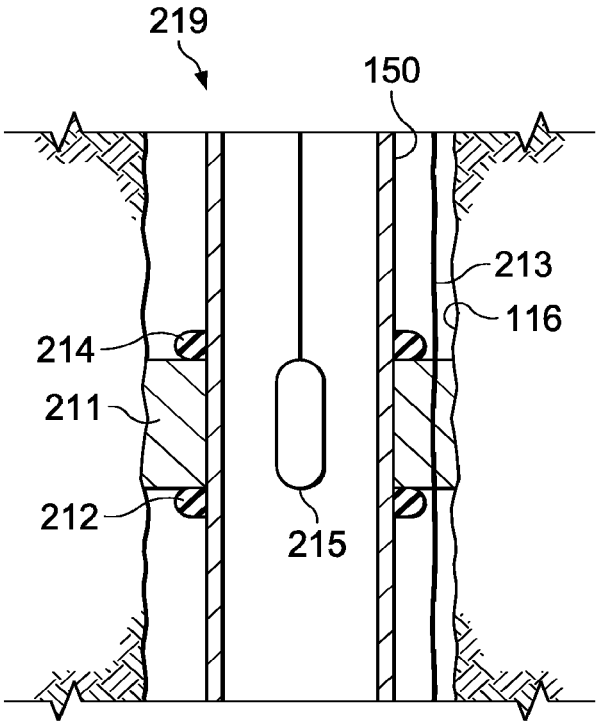
FIG. 2B illustrates a perspective view of another metallic sealant measurement system deployable in the environments of FIGS. 1A and 1B.
Figure 2C:
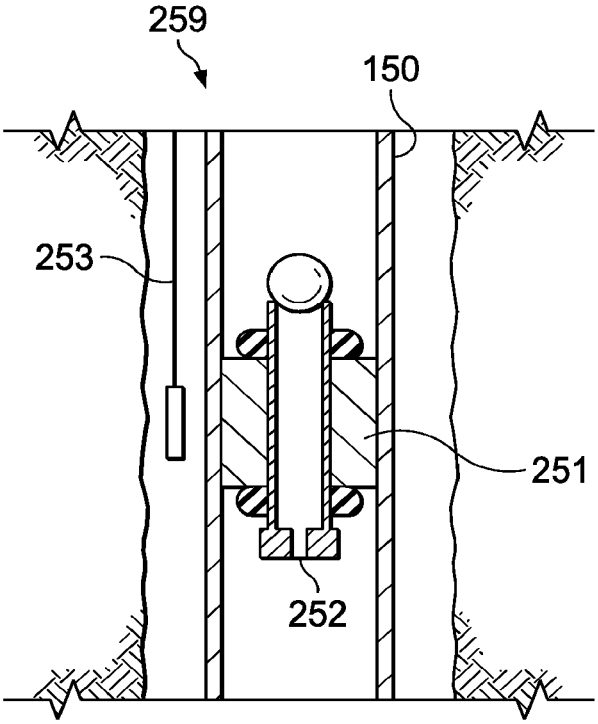
FIG. 2C illustrates a perspective view of another metallic sealant measurement system deployable in the environments of FIGS. 1A and 1B.

As described herein and illustrated in at least FIGS. 2A-2C, the metallic sealant measurement system 119 includes a metallic sealant and a temperature sensor. In some embodiments, the temperature sensor is at least one of a fiber optic cable, a thermometer, and a component of a logging tool. A surface-based fluid (e.g., reacting fluid) flows from the inlet conduit 186 of FIG. 1A, through the annulus 194 of the work string 150. In the embodiments of FIGS. 1A and 1B, the work string 150 has an opening (not shown) that allows fluid to flow through the opening towards the metallic sealant measurement system 119. Exposing the metallic sealant to the reacting fluid initiates a galvanic reaction, which causes an expansion of the metallic sealant, thereby forming a seal.

In one or more embodiments, where the metallic sealant is formed from magnesium, and the reacting fluid is water, the reaction of magnesium and water is expressed as the following:

$$Mg+2H_2O \rightarrow Mg(OH)_2+H_2.$$

In the foregoing embodiment, the amount of heat related is the standard enthalpy of formation for magnesium hydroxide (924 KJ/mol) minus two times the standard enthalpy of formation of water (−2*285 KJ/mol), is 53 KJ/mol released. In one or more embodiments, a eight pound section of the metallic sealant that is formed from magnesium is 149 mol of magnesium. Exposing the eight pound section of magnesium to water would release approximately 53 MJ of energy as heat.

In one or more embodiments, where the metallic sealant is formed from magnesium, and the reacting fluid is water, the reaction of magnesium and water is expressed as the following:

$$Al+3H_2O \rightarrow Al(OH)_3+3/2H_2.$$

In the foregoing embodiment, the amount of heat related is the standard enthalpy of formation for aluminum hydroxide (1277 KJ/mol) minus three times the standard enthalpy of formation of water (−3*285 KJ/mol), is 422 KJ/mol released. In one or more embodiments, an eight pound section of the metallic sealant that is formed from aluminum is 134 mol of aluminum. Exposing the eight pound section of aluminum to water would release approximately 56 MJ of energy as heat.

The temperature sensor monitors heat released from the galvanic reaction and determines a temperature change due to the galvanic reaction. In some embodiments, the temperature change is measured at two different points on the metallic sealant or proximate to the metallic sealant. In some embodiments, the temperature change is the change in temperature at a point on the metallic sealant or proximate to the metallic sealant over time.

In some embodiments, the speed of the chemical reaction is varied by the addition of dopants into the metallic sealant, or by the pH or other additives in the reactive fluid. For example, adding an anhydrous acid powder to the metallic sealant would make the reactive fluid more acidic, which would accelerate the reaction and would allow most or all of the particulates stay in solution than participate into the wellbore 116. In some embodiments, where an acid is added to the reactive fluid, the acid is an inorganic acid, such as Hydrochloric acid. In some embodiments, the acid is an organic acid, such as, but not limited to, citric acid, acetic acid, or formic acid. In some embodiments, the addition of dopants and/or additives decreases the reaction time of galvanic reactions from a period of weeks (e.g., 2 weeks) to minutes (e.g., 15 minutes). Similarly, certain dopants and/or additives are also added to prolong the reaction time of the galvanic reaction or to regulate the reaction time to a desired or a predetermined period of time.

In some embodiments, the expansion of the metallic sealant also displaces fluids (e.g., a non-reacting fluid) into the annulus 194 of the work string 150, where the fluid flows through an outlet conduit 198 into a container 178 of FIG. 1A. In some embodiments, the temperature change detected by the temperature sensor is also used to determine the volume of the non-reacting fluid that has been displaced into the annulus 194 or to another area of the wellbore 116.

Although FIGS. 1A and 1B illustrate completion environments, the metallic sealant measurement system 119 may also be deployed in various production environments or drilling environments where fluid may be guided to the metallic sealant measurement system 119. Further, although FIGS. 1A and 1B illustrate a single metallic sealant measurement system 119, multiple sealant measurement systems 119 may be deployed in the well 112. In some embodiments, where it is desirable to isolate multiple sections of the well 112 and/or to divide the well 112 into multiple zones, multiple sealant measurement systems 119 are simultaneously deployed downhole to set the respective packers. In another one of such embodiments, the wellbore 116 is a multilateral wellbore. In such embodiment, one or more sealant measurement systems 119 described herein may be deployed in each lateral wellbore of the multilateral wellbore to set packers and other downhole elements at the desired locations of each lateral wellbore. Further, although FIGS. 1A and 1B illustrate open-hole configurations, the metallic sealant measurement system 119 described herein may also be deployed in cased-hole configurations. Additional details of the metallic sealant measurement system 119 are provided in the paragraphs below and are illustrated in at least FIGS. 2-5.

FIG. 2A illustrates a perspective view of a metallic sealant measurement system 219 deployable in the environments of FIGS. 1A and 1B. In the embodiment of FIG. 2A, a fiber optic cable 213 that serves as a temperature sensor is deployed in the wellbore 116. Further, metallic sealant 211 is deployed around work string 150 and in between o-rings 212 and 214. In the illustrated embodiment, reacting fluid flows out of work string 150 through an opening (not shown). Further, exposure to the reacting fluid initiates a galvanic reaction, which causes the metallic sealant 211 to expand until a seal is formed between the work string 150 and the wellbore 116. Further, the fiber optic cable 213 determines the temperature change due to heat released as a result of the galvanic reaction. The temperature change is used (e.g., by a downhole tool, a surface-based system, by the temperature sensor, or by another device or component) to determine the amount of the expansion of the metallic sealant 211 and the speed of the expansion. In some embodiments, the temperature change is also used to calculate fluid displacement of fluids (e.g., non-reactive fluids).

FIG. 2B illustrates another perspective view of the metallic sealant measurement system 219 deployable in the environments of FIGS. 1A and 1B. In the embodiment of FIG. 2B, the fiber optic cable 213 and a component of logging tool 215 are both temperature sensors of the metallic sealant measurement system 219. In the illustrated embodiment of FIG. 2B, the metallic sealant 211 that is deployed between the o-rings 212 and 214 has formed a seal between the work string 150 and the wellbore 116. In some embodiments, wellbore operations or contaminants may break the seal between the work string 150 and the wellbore 116, thereby exposing a previously unexposed portion of the metallic sealant 211. In such embodiments, a reacting fluid may be poured into work string 150, and exposure of the unexposed portion of the metallic sealant 211 to the reacting fluid causes another galvanic reaction. The second galvanic reaction causes the previously unexposed portion of the metallic sealant 211 to expand and to form another seal between the work string 150 and the wellbore 116. In the embodiment of FIG. 2B, the temperature change due to the second galvanic reaction is measured by the logging tool 215 and/or by the fiber optic cable. Further, the logging tool 215 then determines whether a second seal has been formed based on the change in the temperature and/or the rate of change in the temperature due to the galvanic reaction.

FIG. 2C illustrates a perspective view of another metallic sealant 251 measurement system 259 deployable in the environments of FIGS. 1A and 1B. In the embodiment of FIG. 2C, a dissolvable frac plug 252 and metallic sealant 251 are deployed within work string 150, whereas wireless temperature sensor 253 is deployed along the exterior surface of the work string 150. In the illustrated embodiment, exposure of the metallic sealant 251 to a reacting fluid initiates a galvanic reaction, which causes the metallic sealant 251 to expand until the metallic sealant 251 forms a seal within the work string 150. Further, wireless temperature sensor 253 detects a change in the temperature due to the galvanic reaction, and the change in the temperature is used to determine the amount of expansion and whether a seal has been formed. In some embodiments, the dissolvable frac plug 252 releases heat when it dissolves. In one or more of such embodiments, the wireless temperature sensor 253 measures heat released by the dissolvable frac plug 252 to determine whether the dissolvable frac plug 252 is dissolving.

Figure 3:
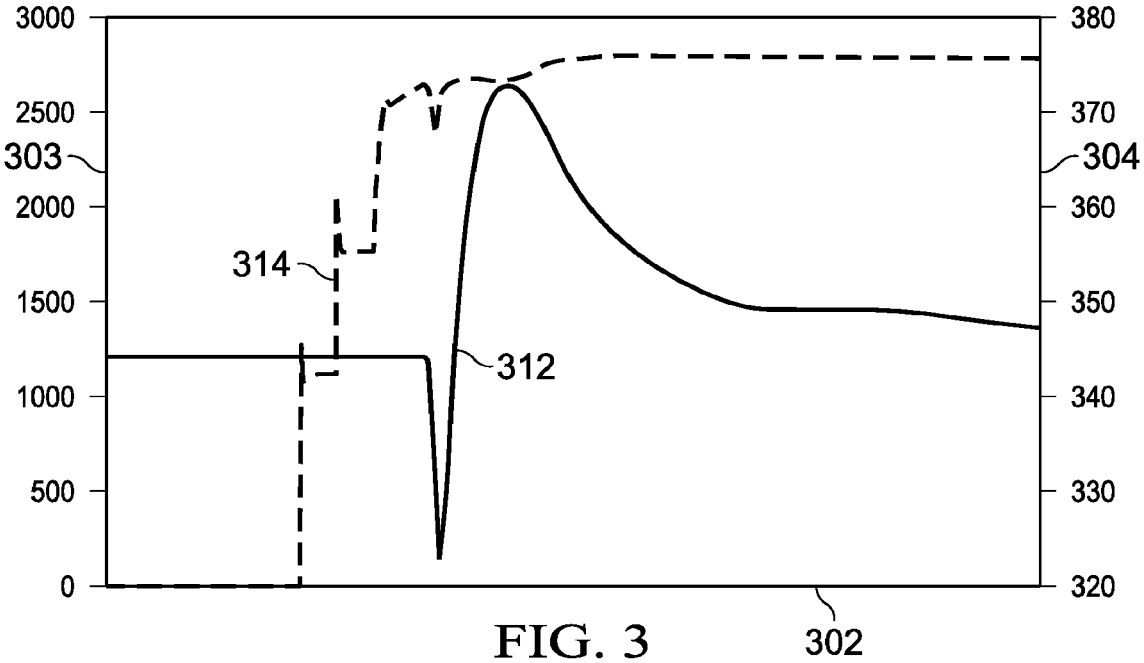
FIG. 3 illustrates a plot of the change in temperature at a location proximate to a metallic sealant in response to a change in pressure applied to the metallic sealant.

FIG. 3 illustrates a plot of the change in temperature at a location proximate to a metallic sealant in response to a change in pressure applied to the metallic sealant. In the embodiment of FIG. 3, x-axis 302 represents time, numerical values on left y-axis 303 represent pressure, numerical values on right y-axis 304 represent temperature in Fahrenheit, line 312 represents a change in temperature, and line 314 represents differential pressure. As shown in FIG. 3, the wellbore temperature is initially approximately 343 degrees. An increase in pressure to 2500 psi causes an initial drop in temperature from approximately 343 degrees to 323 degrees and a subsequent spike to 373 degrees. The drop in temperature represents a leak in a seal formed by the metallic sealant caused by a pressure increase to 2500 psi. The failure of the metallic sealant exposes additional portions of the metallic sealant, which were previously unexposed to a reacting fluid during the formation of the initial seal. Further, exposure of the previously unexposed portions of the metallic sealant to the reacting fluid causes another galvanic reaction, which expands the metallic metal, thereby forming a second seal. In that regard, a temperature increase from approximately 323 degrees to 373 degrees as shown by line 312 represents heat released as a result of the second galvanic reaction due to the exposure of the previously unexposed portions of the metallic sealant to the reacting fluid. The metallic sealant continues to expand until a second seal is formed, after which further exposure of surface areas of the metallic sealant, which have already been exposed to the reacting fluid, no longer causes a galvanic reaction. In one or more embodiments, the metallic sealant ceases to expand due to the surface area of the metallic metal having already reacted with the reacting fluid. After completion of the galvanic reaction, heat is no longer released as a byproduct and the wellbore temperature drops towards 343 degrees, which is the natural wellbore temperature. The drop in temperature is illustrated by line 312, which shows a gradual degree from 373 degrees towards 343 degrees. As illustrated in FIG. 3, the changes in temperature and pressure indicate several events including initial failure of the metallic sealant (due to pressure), exposure of previously unexposed portions of the metallic sealant to a reacting fluid, expansion of the metallic sealant to form a new seal, and formation of the new seal.

Figure 4:
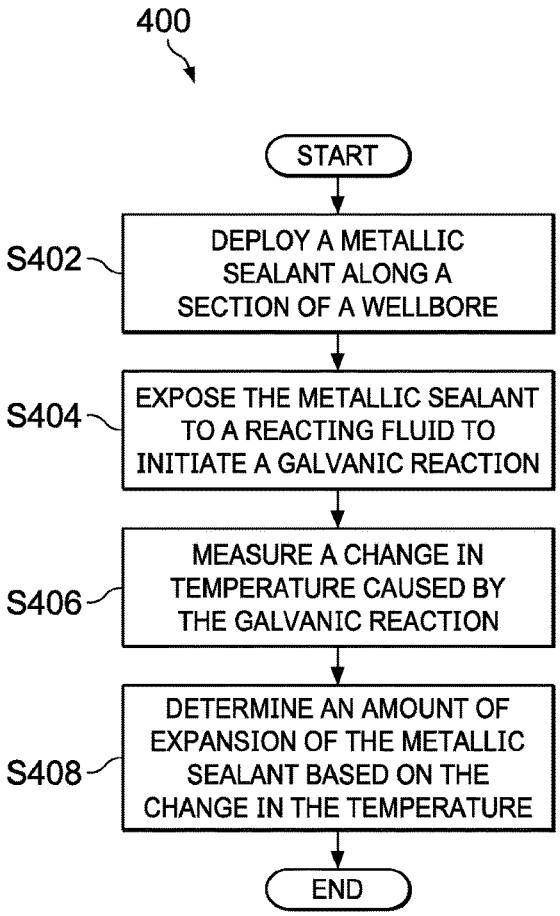
FIG. 4 is a flow chart of a process to monitor expansion of a downhole metallic sealant.

FIG. 4 is a flow chart of a process 400 to monitor the expansion of a downhole metallic sealant. Although the operations in the process 400 are shown in a particular sequence, certain operations may be performed in different sequences or at the same time where feasible. Further, although the process 400 is described to be performed by sealant measurement system 119, 219, or 259 of FIGS. 1A-1B and 2A-2C, the process may be performed by other types of sealant measurement systems or components of such sealant measurement systems described herein. At block S402, a metallic sealant (e.g., metallic sealant 211 of FIGS. 2A and 2B) is deployed along a section of a wellbore (e.g., wellbore 116 of FIGS. 1A and 1B). At block S404, the metallic sealant 211 is exposed to a reacting fluid to initiate a galvanic reaction. In some embodiments, the reacting fluid is introduced into the wellbore 116 after deployment of the metallic sealant 211. In some embodiments, the metallic sealant 211 is deployed along a section of the wellbore 116 that contains the reacting fluid. At block S406, a change in the temperature caused by the galvanic reaction is measured. In the embodiments, of FIGS. 2A and 2B, fiber optic cable 213 and/or the logging tool 215 measure the change in the temperature caused by the galvanic reaction. At block S408, a determination of an amount of expanded metallic sealant is made based on the change in the temperature and/or the rate in the change in temperature. In the embodiment of FIG. 2B the logging tool 215 determines the amount of expanded metallic sealant 211 as a result of the galvanic reaction. In other embodiments, other tools or devices deployed downhole or on the surface determines the amount of expanded metallic sealant based on the detected temperature change. In some embodiments, the sealant measurement system 119, 219, or 259 of FIGS. 1A-1B and 2A-2C also performs a pressure test to determine the amount of expansion of the metallic sealant 211 and to determine whether a seal has been formed. In some embodiments, a sealant capacity of the metallic sealant is determined based on the amount of expansion of the metallic sealant. In some embodiments, the sealant capacity is determined by a downhole tool, such as by the logging tool 215 of FIG. 2B, or by another tool that is deployed downhole. In some embodiments, data indicative of measurements of the expansion of the metallic sealant are transmitted to the surface and the sealant capacity is determined by a surface based electronic device or system.

In some embodiments, the logging tool 215 of FIG. 2B continuously and/or periodically monitors the integrity of the metallic sealing and the seal created by the metallic sealing. In some embodiments, after an initial seal has been formed, the metallic sealant 211 experiences a pressure differential (intentional or accidental), which causes the seal to break and exposes previously unexposed sections of the metallic sealant 211 to the reacting fluid. In one or more embodiments, the sealant measurement system 119, 219, or 259 of FIGS. 1A-1B and 2A-2C detects a differential pressure across two points of the metallic sealant 211 or the pressure differential at one point over a period of time, determines a partial or complete loss of integrity of the metallic sealant 211. In one or more embodiments, the exposure of the previously unexposed sections of the metallic sealant 211 to the reacting fluid causes another galvanic reaction. In such embodiments, the optic cable 213 and/or the logging tool 215 of FIG. 2B measures a change in the temperature caused by the second galvanic reaction and determines the amount of a second expansion of the metallic sealant 211 based on the change in the temperature, and whether the second seal has formed.

Figure 5:
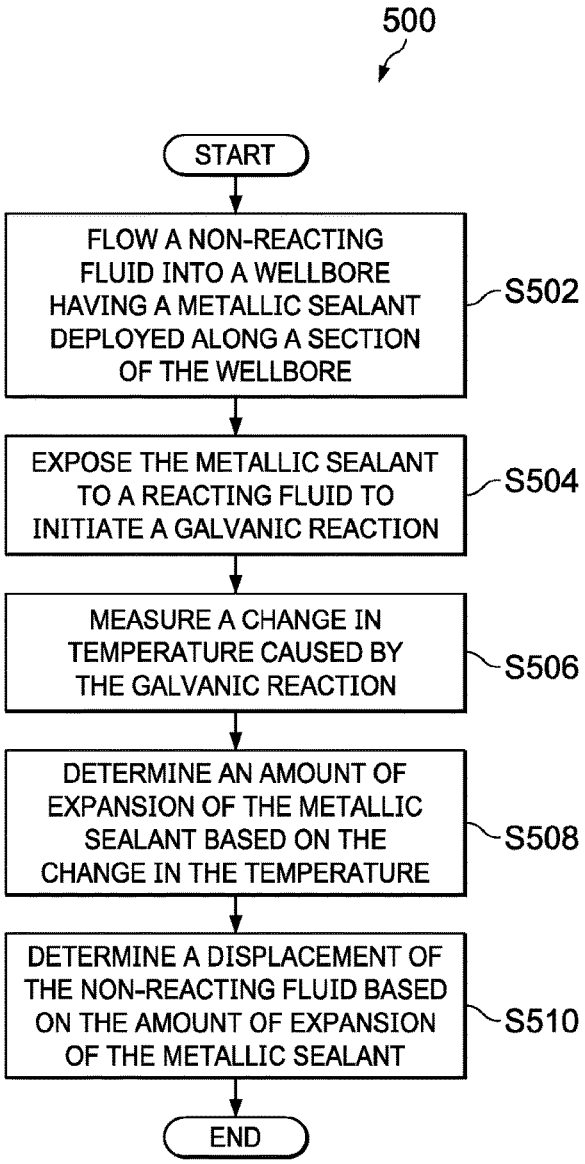
FIG. 5 is a flow chart of a process to monitor downhole fluid displacement.

FIG. 5 is a flow chart of a process 500 to monitor downhole fluid displacement. Although the operations in the process 500 are shown in a particular sequence, certain operations may be performed in different sequences or at the same time where feasible. Further, although the process 500 is described to be performed by sealant measurement system 119, 219, or 259 of FIGS. 1A-1B and 2A-2C, the process may be performed by other types of sealant measurement systems or components of such sealant measurement systems described herein. At block S502, a non-reacting fluid flows into a wellbore (e.g., wellbore 116 of FIG. 1A) having a metallic sealant (e.g., metallic sealant 211 of FIGS. 2A and 2B) deployed along a section of the wellbore 116. At block S504, the metallic sealant 211 is exposed to a reacting fluid to initiate a galvanic reaction. In some embodiments, the reacting fluid is introduced into the wellbore after deployment of the metallic sealant 211. In some embodiments, the metallic sealant 211 is deployed along a section of the wellbore that contains the reacting fluid. At block S506, a change in the temperature caused by the galvanic reaction is measured. At block S508, a determination of an amount of expanded metallic sealant is made based on the change in the temperature. At block S510, a displacement of the non-reacting fluid is determined based on the amount of expansion of the metallic sealant. In the embodiment of FIG. 2B, the logging tool 215 calculates the volume of the non-reacting fluid displaced due to the expansion of the metallic sealant 211.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a method to monitor expansion of a downhole metallic sealant, the method comprising deploying a metallic sealant along a section of a wellbore; exposing the metallic sealant to a reacting fluid to initiate a galvanic reaction; measuring a change in temperature caused by the galvanic reaction; determining an amount of expansion of the metallic sealant based on the change in the temperature; and determining a sealant capacity of the metallic sealant based on the amount of expansion of the metallic sealant.

Clause 2, a method of clause 1, further comprising applying pressure to the metallic sealant to expose a previously unexposed section of the metallic sealant; exposing the previously unexposed section of the metallic sealant to the reacting fluid to initiate a second galvanic reaction; measuring a change in temperature caused by the second galvanic reaction; and determining an amount of a second expansion of the metallic sealant based on the change in the temperature caused by the second galvanic reaction.

Clause 3, the method of any of clauses 1-2, further comprising monitoring an integrity of the metallic sealant based on the change in the temperature.

Clause 4, the method of any of clauses 1-3, further comprising detecting a differential pressure across two points of the metallic sealant; determining a partial loss of integrity of the metallic sealant in response to detecting the differential pressure; after detecting the differential pressure, detecting an increase in temperature proximate to the two points of the metallic sealant; and in response to detecting the increase in temperature proximate to the two points, determining whether the integrity of the metallic sealant has been restored.

Clause 5, the method of any of clauses 1-4, further comprising performing a pressure test to determine the amount of expansion of the metallic sealant.

Clause 6, method of any of clauses 1-5, further comprising determining a rate of the galvanic reaction, wherein the rate of the galvanic reaction is based on an amount of dopant added to the metallic sealant.

Clause 7, the method of any of clauses 1-6, further comprising measuring displacement of a non-reacting fluid deposited in the wellbore, wherein the non-reacting fluid is displaced by the expansion of the metallic sealant; and determining the amount of expansion of the metallic sealant based on the displacement of the non-reacting fluid.

Clause 8, the method of any of clauses 1-4, wherein a fiber optic cable is deployed proximate to the metallic sealant, and wherein measuring the change in temperature comprises utilizing the fiber optic cable to measure the change in temperature.

Clause 9, the method of any of clauses 1-8, wherein a thermometer is deployed proximate to the metallic sealant, and wherein measuring the change in temperature comprises utilizing the thermometer to measure the change in temperature.

Clause 10, the method of any of clauses 1-9, further comprising determining a sealant capacity of the metallic sealant based on the amount of expansion of the metallic sealant.

Clause 11, the method of any of clauses 1-10, further comprising flowing the reacting fluid into the wellbore.

Clause 12, the method of any of clauses 1-10, wherein metallic sealant is deployed at a section of the wellbore that contains the reacting fluid.

Clause 13, a method to monitor downhole fluid displacement, the method comprising flowing a non-reacting fluid into a wellbore having a metallic sealant deployed along a section of the wellbore; exposing the metallic sealant to a reacting fluid to initiate a galvanic reaction; measuring a change in temperature caused by the galvanic reaction; determining an amount of expansion of the metallic sealant based on the change in the temperature; and determining a displacement of the non-reacting fluid based on the amount of expansion of the metallic sealant.

Clause 14, the method of clause 13, further comprising applying pressure to the metallic sealant to expose a previously unexposed section of the metallic sealant; exposing the previously unexposed section of the metallic sealant to the reacting fluid to initiate a second galvanic reaction; measuring a change in temperature caused by the second galvanic reaction; and determining an amount of a second expansion of the metallic sealant based on the change in the temperature caused by the second galvanic reaction; and determining a displacement of the non-reacting fluid based on the amount of the second expansion of the metallic sealant.

Clause 15, the method of any of clauses 13 or 14, further comprising monitoring an integrity of the metallic sealant based on the change in the temperature.

Clause 16, the method of any of clauses 13-15, further comprising detecting a differential pressure across two points of the metallic sealant; determining a partial loss of integrity of the metallic sealant in response to detecting the differential pressure; after detecting the differential pressure, detecting an increase in temperature proximate to the two points of the metallic sealant; and in response to detecting the increase in temperature proximate to the two points, determining whether the integrity of the metallic sealant has been restored.

Clause 17, a downhole metallic sealant measurement system, comprising a galvanically corrodible metallic sealant deployed along a section of a wellbore, wherein a galvanic reaction is initialed when the galvanically corrodible metallic sealant is exposed to a reacting fluid, and wherein the galvanic reaction causes an expansion of the galvanically corrodible metallic sealant to isolate a section of the wellbore; and a temperature sensor positioned proximate to the galvanically corrodible metallic sealant and operable to determine a temperature change caused by the galvanic reaction, wherein an amount of expansion of the metallic sealant is determined based on the temperature change caused by the galvanic reaction.

Clause 18, the downhole metallic sealant measurement system of cause 17, wherein the temperature sensor is at least one of a fiber optic cable, a thermometer, and a component of a logging tool.

Clause 19, the downhole metallic sealant measurement system of any of clauses 17 or 18, wherein the temperature sensor is operable to measure a difference in temperature at two different points proximate to the metallic sealant to determine the temperature change.

Clause 20, the downhole metallic sealant measurement system of any of clauses 17-19, further comprising a pressure sensor operable to detect a differential pressure at two different points of the galvanically corrodible metallic sealant.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A method to monitor expansion of a metallic sealant, the method comprising:

deploying the metallic sealant along a section of a wellbore;

exposing the metallic sealant to a reacting fluid to initiate a galvanic reaction, wherein the metallic sealant is configured to expand as a result of being exposed to the reacting fluid;

measuring, with a downhole temperature sensor deployed in the wellbore, a change in temperature due to heat released by the metallic sealant as a result of the galvanic reaction; and determining an amount of expansion of the metallic sealant based on the change in the temperature and as a result of the galvanic reaction.

2. The method of claim 1, further comprising:

applying pressure to the metallic sealant to expose a previously unexposed section of the metallic sealant;

exposing the previously unexposed section of the metallic sealant to the reacting fluid to initiate a second galvanic reaction;

measuring a change in temperature caused by the second galvanic reaction; and determining an amount of a second expansion of the metallic sealant based on the change in the temperature caused by the second galvanic reaction.

3. The method of claim 1, further comprising monitoring an integrity of the metallic sealant based on the change in the temperature.

4. The method of claim 3, further comprising:

detecting a differential pressure across two points of the metallic sealant;

determining a partial loss of integrity of the metallic sealant in response to detecting the differential pressure;

after detecting the differential pressure, detecting an increase in temperature proximate to the two points of the metallic sealant; and in response to detecting the increase in temperature proximate to the two points, determining whether the integrity of the metallic sealant has been restored.

5. The method of claim 1, further comprising performing a pressure test to determine the amount of expansion of the metallic sealant.

6. The method of claim 1, further comprising determining a rate of the galvanic reaction, wherein the rate of the galvanic reaction is based on an amount of dopant added to the metallic sealant.

7. The method of claim 1, further comprising:

measuring displacement of a non-reacting fluid deposited in the wellbore, wherein the non-reacting fluid is displaced by the expansion of the metallic sealant; and determining the amount of expansion of the metallic sealant based on the displacement of the non-reacting fluid.

8. The method of claim 1, wherein a fiber optic cable is deployed proximate to the metallic sealant, and wherein measuring the change in temperature comprises utilizing the fiber optic cable to measure the change in temperature.

9. The method of claim 1, wherein a thermometer is deployed proximate to the metallic sealant, and wherein measuring the change in temperature comprises utilizing the thermometer to measure the change in temperature.

10. The method of claim 1, further comprising determining a sealant capacity of the metallic sealant based on the amount of expansion of the metallic sealant.

11. The method of claim 1, further comprising flowing the reacting fluid into the wellbore.

12. The method of claim 1, wherein metallic sealant is deployed at a section of the wellbore that contains the reacting fluid.

13. A method to monitor downhole fluid displacement, the method comprising:

flowing a non-reacting fluid into a wellbore having a metallic sealant deployed along a section of the wellbore;

exposing the metallic sealant to a reacting fluid to initiate a galvanic reaction;

measuring, with a downhole temperature sensor deployed in the wellbore, a change in temperature due to heat released by the metallic sealant as a result of the galvanic reaction;

determining an amount of expansion of the metallic sealant based on the change in the temperature; and determining a displacement of the non-reacting fluid based on the amount of expansion of the metallic sealant and as a result of the galvanic reaction.

14. The method of claim 13, further comprising:

applying pressure to the metallic sealant to expose a previously unexposed section of the metallic sealant;

exposing the previously unexposed section of the metallic sealant to the reacting fluid to initiate a second galvanic reaction;

measuring a change in temperature caused by the second galvanic reaction; and determining an amount of a second expansion of the metallic sealant based on the change in the temperature caused by the second galvanic reaction; and determining a displacement of the non-reacting fluid based on the amount of the second expansion of the metallic sealant.

15. The method of claim 13, further comprising monitoring an integrity of the metallic sealant based on the change in the temperature.

16. The method of claim 13, further comprising:

detecting a differential pressure across two points of the metallic sealant;

determining a partial loss of integrity of the metallic sealant in response to detecting the differential pressure;

after detecting the differential pressure, detecting an increase in temperature proximate to the two points of the metallic sealant; and in response to detecting the increase in temperature proximate to the two points, determining whether the integrity of the metallic sealant has been restored.

17. A downhole metallic sealant measurement system, comprising:

a galvanically corrodible metallic sealant deployed along a section of a wellbore, wherein a galvanic reaction is initialed when the galvanically corrodible metallic sealant is exposed to a reacting fluid, and wherein the galvanic reaction causes an expansion of the galvanically corrodible metallic sealant to isolate a section of the wellbore, wherein the metallic sealant is configured to expand as a result of being exposed to the reacting fluid;

a temperature sensor positioned proximate to the galvanically corrodible metallic sealant and operable to determine a temperature change due to heat released as a result of the galvanic reaction; and a logging tool configured to determine an amount of expansion of the metallic sealant based on the temperature change and as a result of the galvanic reaction.

18. The downhole metallic sealant measurement system of claim 17, wherein the temperature sensor is at least one of a fiber optic cable, a thermometer, and a component of the logging tool.

19. The downhole metallic sealant measurement system of claim 17, wherein the temperature sensor is operable to measure a difference in temperature at two different points proximate to the metallic sealant to determine the temperature change.

20. The downhole metallic sealant measurement system of claim 17, further comprising a pressure sensor operable to detect a differential pressure at two different points of the galvanically corrodible metallic sealant.

* * * * *